US006499404B1

(12) United States Patent
Kern et al.

(10) Patent No.: US 6,499,404 B1
(45) Date of Patent: Dec. 31, 2002

(54) IGNITION ELEMENT WITH A LASER LIGHT SOURCE

(75) Inventors: Heinz Kern, Furth (DE); Gerhard Kordel, Nuremberg (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 0 days.

(21) Appl. No.: 09/763,193

(22) PCT Filed: Aug. 7, 1999

(86) PCT No.: PCT/EP99/05719

§ 371 (c)(1),
(2), (4) Date: Apr. 13, 2001

(87) PCT Pub. No.: WO00/11428

PCT Pub. Date: Mar. 2, 2000

(30) Foreign Application Priority Data

Aug. 20, 1998 (DE) ..... 198 37 839

(51) Int. Cl.[7] ..... F42B 3/113

(52) U.S. Cl. ..... 102/201; 102/202.12

(58) Field of Search ..... 102/201, 202.12

(56) References Cited

U.S. PATENT DOCUMENTS

| | | | | | |
|---|---|---|---|---|---|
| 4,660,472 | A | * | 4/1987 | Stevens | 102/202.1 |
| 5,204,490 | A | * | 4/1993 | Soltz et al. | 102/201 |
| 5,206,455 | A | * | 4/1993 | Williams et al. | 102/201 |
| 5,212,339 | A | * | 5/1993 | Piltch | 102/202 |
| 5,660,413 | A | * | 8/1997 | Bergerson et al. | 280/741 |
| 5,756,924 | A | * | 5/1998 | Early | 102/201 |
| 6,374,740 | B1 | * | 4/2002 | Moulard | 102/201 X |

* cited by examiner

*Primary Examiner*—Peter A. Nelson
(74) *Attorney, Agent, or Firm*—Antonelli, Terry, Stout & Kraus, LLP

(57) ABSTRACT

In ignition elements where the energy required to ignite the charge is produced using a laser source, the laser light is injected by means of an optical fiber or a laser optics system enabling the laser light to be focused onto the charge at the required intensity for ignition. Transmission losses and injection losses occur while the laser light is transmitted by means of optical devices or optical fibers. Known ignition devices are also complicated in terms of construction. According to the invention, the laser light source is a laser diode (3) and the explosive (4) that is to be ignited is arranged directly on the part (12) of the housing (8) of the laser diode (3) that allows the laser light (13) to pass through it.

6 Claims, 1 Drawing Sheet

IGNITION ELEMENT WITH A LASER LIGHT SOURCE

Figure 1:
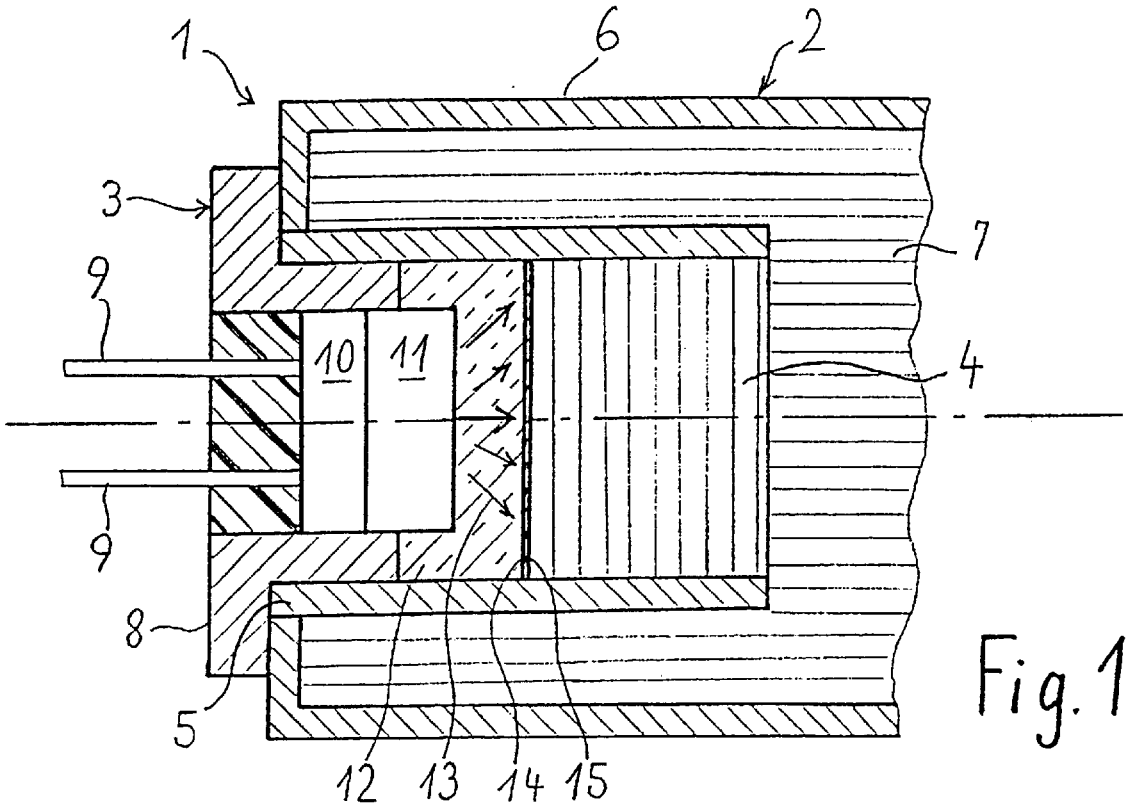

The invention relates to an ignition element having a laser light source corresponding to the preamble of the first claim.

Ignition elements are known in which the explosive which triggers the primer detonation is ignited by means of a laser light source. The laser light source is arranged outside the space which contains the explosive. The laser light is routed to the explosive of the primer detonation either by way of a light guide or by way of a through channel. As a rule, a laser optical system is required in order to couple the laser light into the through channel, in order to focus the laser light onto the explosive with the intensity required for ignition. The explosion of the primer ignites the charge of a detonation body, for example a bullet. The detonation body can, however, also contain a charge with an explosive, for the ignition of which the energy of the laser light is already sufficient, so that a primer detonation is not required.

Two versions of an ignition element are known from U.S. Pat. No. 3,362,329. With the first version, the laser light is supplied by means of a light guide from the laser light source to the explosive of the ignition element. In this connection, a coupled optical system is connected between the light guide and the explosive of the ignition element. According to the second version, the laser light source is arranged in such a way that the laser light is routed onto the explosive of the ignition element through an opening in a shield, which separates the laser light source from the explosive of the ignition element, and an insulating tube connected thereto containing the filtering and amplifying optical system. The known ignition elements have the disadvantage that the light guide, with its coupled optical system or the filtering and amplifying optical system to be connected upstream of the laser light source are costly in construction terms. Apart from this, transmission losses and coupling losses occur when laser light is transmitted by means of optical devices or light guides.

The object of the present invention is to provide an ignition element having a laser light source which is comparatively simple and cheap to produce and does not have the disadvantages mentioned above.

The object is achieved with the aid of the characterising features of the first claim. Advantageous developments of the invention are claimed in the subclaims.

As a result of the continuing miniaturisation and cost-favourable production of electronic components, it is possible to produce laser light sources in such a size, and thereby nevertheless having such a radiant intensity, that, in accordance with the invention, they can ignite explosives without a light guide or filtering and amplifying optical system. The laser light source is a laser diode which is still only intended for a single use. In this connection, the explosive to be ignited can rest directly on the portion of the housing of the laser diode that is permeable to the laser light, the outlet surface of the laser light. The production of ignition elements is made simpler and cheaper because the laser light does not have to be coupled by way of an optical system or a light guide. Apart from this, transmission losses and coupling losses are avoided.

In an advantageous development of the invention, the portion of the housing of the laser diode that faces the explosive to be ignited and is permeable to laser light can be coated with a substance which improves the absorption of the laser light, in particular the infrared portion. As a result of this, the action of the laser light is intensified. Carbon or black metal oxides, such as copper oxide, iron oxide and manganese oxide for example, absorb the infrared light particularly well.

In another development of the invention, the substances which improve the absorption of the laser light can be added to the explosive to be ignited itself. A prerequisite is that the purpose-specific action of the explosive is not impaired by the addition. As a result of the addition, a separate working step for coating the laser diode with the absorption material becomes unnecessary.

Moreover, the laser diode can be embedded in the explosive to be ignited, in which case it is advantageous if its electrical connections are exposed. A comparatively large surface is available for the introduction of the energy required for ignition. In the case of an embedded laser diode.

In a further development of the invention, the explosive to be ignited and the laser diode can be surrounded by a common housing. As a result of this, particularly in the case of primers, the explosive and the laser diode as ignition device can be put together in a one-piece component having small dimensions.

Embodiments in which the explosive and the laser diode are put together in a common housing are suitable, in particular, for gas generators, as used, for example, in air-bags or in belt tighteners.

The invention is explained in greater detail with the aid of exemplifying embodiments.

Figure 2:
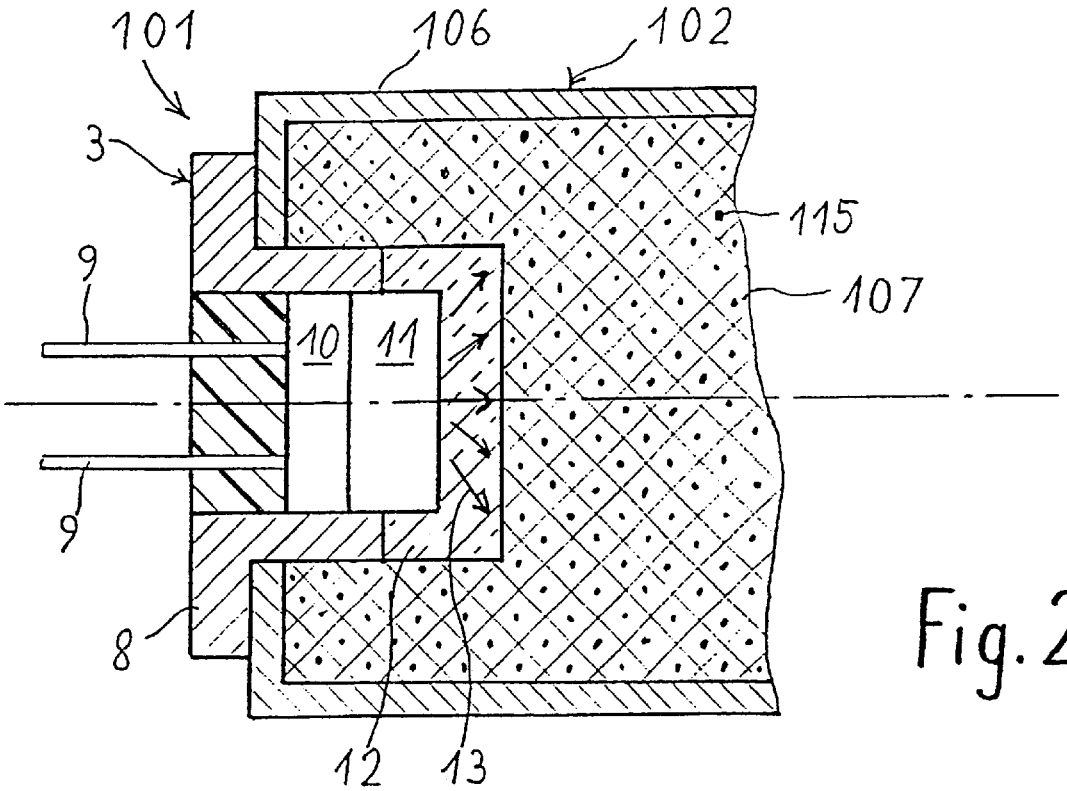

FIG. 1 shows a section through a detonation body, in which the laser diode and the explosive are surrounded by a common housing and form an ignition element provided for the primer detonation, and FIG. 2 shows a section through a detonation body, in which the laser diode is embedded directly in the explosive to be ignited.

FIG. 1 shows an ignition element 1 in a detonation body 2 in a sectional drawing. In the present exemplifying embodiment, the ignition element 1 comprises a laser diode 3, which is accommodated in a common housing 5, together with the explosive 4 which triggers the primer detonation. This ignition element 1 is inserted into the housing 6 of the detonation body 2 and extends into the explosive charge or power charge 7 of the latter. The connections 9 to the power supply of the control chip 10 of the laser diode 3 project out of the housing 8 of the laser diode 3. The housing 12 of the laser diode 3 is permeable to the laser light 13 in the region of the laser 11. of the housing portion 12 that is permeable to the laser light 13, the portion that faces the explosive 4 for the primer detonation forms a window 14 in the common housing 5 of the laser diode 3 and explosive 4.

Laser light 13, which is adjusted to the ignition of the explosive 4 for the primer detonation, is generated. The laser light 13 emerges a certain angle, as a rule between 20° and 30°, from the laser 11, strikes the explosive 4 and ignites it. The energy density of the laser light 13 is dependent on the construction of the laser diode 3 and thus its power output, on the angle of emergence of the laser light 13 and the distance between the laser 11 and the explosive 4.

The ignition performance of the charge can be improved substantially if the window 14 of the laser diode 3 is coated with a substance 15 which improves the absorption of the laser light 13, in particular the infrared portion.

FIG. 2 shows a further exemplifying embodiment of the invention. In the present exemplifying embodiment, the structure of the laser diode does not differ from the laser diode in the exemplifying embodiment according to FIG. 1. For this reason, corresponding components are denoted with the same reference numbers.

In the present exemplifying embodiment, the ignition element 101 comprises the laser diode 3, which is inserted directly into the explosive of the charge 107 of the detonation body 102 and is completely surrounded thereby, with the exception of the electrical connections 9. In the present exemplifying embodiment, the charge 107 does not require a primer detonation. The energy which is introduced into the charge 107 by the laser light 13 from the laser diode 3 is sufficient to ignite the charge. The housing 106 of the detonation body 102 surrounds both the charge 107 and the ignition element 101. A substance 115 which improves the absorption of the laser light 13, in particular its infrared portion, is added directly to the explosive of the charge 107.

Because of their simple structure and the small size, the ignition elements in accordance with the invention are suitable, in particular, for installation in gas generators which are used in air-bags and belt tighteners.

What is claimed is:

1. Ignition element having a laser light source for igniting the explosive in a detonation body, characterised in that the laser light source is a laser diode (3), and in that the explosive (4, 107) to be ignited is arranged directly on the portion (12) of the housing (8) of the laser diode (3) that is permeable to the laser light (13).

2. Ignition element according to claim 1, characterised in that the portion (12) of the housing (8) of the laser light (3) that is permeable to the laser light (13) is coated with a substance (15) which improves the absorption of the laser light (13), in particular the infrared portion.

3. Ignition element according to claim 1, characterised in that a substance (115) which improves the absorption of the laser light (13), in particular the infrared portion, is added to the explosive (107) to be ignited by means of the laser light (13).

4. Ignition element according to claim 1, characterised in that the explosive (4, 107) and the laser diode (3) are surrounded by a common housing (5, 106).

5. Ignition element according to claim 1, characterised in that the laser diode (3) is embedded in the explosive (107).

6. Ignition element according to claim 1, characterised in that it is used in gas generators which are used, in particular, in air-bags and belt tighteners.

* * * * *